US006378578B2

(12) United States Patent
Thomas

(10) Patent No.: US 6,378,578 B2
(45) Date of Patent: Apr. 30, 2002

(54) CUTTER HEAD

(75) Inventor: Herbert Thomas, Memmingen (DE)

(73) Assignee: Stehle GmbH & Co. KG (DE)

( * ) Notice: Subject to any disclaimer, the term of this patent is extended or adjusted under 35 U.S.C. 154(b) by 0 days.

(21) Appl. No.: 09/777,075

(22) Filed: Feb. 5, 2001

(30) Foreign Application Priority Data

Feb. 8, 2000 (DE) ..... 100 05 467

(51) Int. Cl.[7] ..... B27C 5/00

(52) U.S. Cl. ..... 144/230; 144/218; 144/229; 144/241; 407/34; 407/37; 407/40; 407/49; 83/698.41

(58) Field of Search ..... 144/218, 229, 144/230, 241; 83/698.41; 407/34, 36, 37, 38, 40, 47, 49, 109, 104, 106, 107

(56) References Cited

U.S. PATENT DOCUMENTS 2,751,006 A 6/1956 Lane
5,658,101 A 8/1997 Hammer
6,189,584 B1 * 2/2001 Cayce ..... 144/230

FOREIGN PATENT DOCUMENTS

| | | |
|---|---|---|
| EP | 0 156 934 | 10/1985 |
| EP | 0 321 391 | 6/1989 |
| EP | 0 726 838 | 4/1994 |
| WO | PCT/SE96/1298 | 4/1997 |

* cited by examiner

*Primary Examiner*—W Donald Bray
(74) *Attorney, Agent, or Firm*—Marshall, Gerstein & Borun

(57) ABSTRACT

Cutter head for wood working machines comprising a carrier with at least one receptacle for detachably receiving a cutter unit and a means for adjusting the flight circle of a cutting edge of the cutter unit, wherein in order to facilitate such a cutter head in view of the manufacture and installation thereof and to improve the resharpening ability of the cutter unit, the adjusting means comprises at least one spacer arranged between the cutting edge and the receptacle in an exchangeable manner and defining the distance between the cutting edge and a bearing surface of the receptacle.

16 Claims, 5 Drawing Sheets

CUTTER HEAD

FIELD OF THE INVENTION

The invention relates to a cutter head for wood working machines.

Such cutter heads are, for instance, used for milling, profiling or planing wood, and, depending on the required cutting performance and the material to be processed, they may be equipped with compact cutters made of the usual cutting steels or with hard metal cutting plates and support plates placed underneath.

BACKGROUND OF THE INVENTION

A cutter head for wood working machines having a hard metal cutting plate and a support plate placed underneath is known from EP 726 838 B1. In order to guarantee that the cutting edge can rotate again on the same flight circle also after it has been resharpened, the cutting plate can be adjusted. For this purpose the cutting plate comprises a micro toothing on the reverse side thereof engaging into a corresponding micro toothing of the support plate. The micro toothings extend axially relative to the flight circle and have a predetermined distance radially thereto. If the cutting plate needs resharpening, the pressure of the cutting plate acting against the support plate is released and the cutting plate is offset outwardly relative to the support plate by one tooth of the micro toothing. Thus the cutting plate can be resharpened in a manner that the cutting edge is positioned again on the previous flight circle after the resharpening. The possibility of adjustment by micro toothings engaging each other, however, has essential disadvantages. On one hand it is not excluded that the cutting place is inadvertently adjusted by more than one tooth, with the result that more of the expensive hard metal material than would be actually necessary is cut off. Also the mounting of the known cutter unit is difficult, since it has to be secured that the selected engagement points of the micro toothing are maintained also when the cutter unit is inserted and tightened. Moreover, the micro toothings must come up to requested dimensions and must be manufactured with precision, which in view of hard metal cutting plates is possible only with expensive diamond tools. Finally, the cutting plate is in a radial direction only supported on the support plate by the relatively small oblique surfaces of the micro toothing, so that relatively high pressure forces are required.

SUMMARY OF THE INVENTION

Therefore, the invention is based on the object to provide an easy to manufacture and easy to mount cutter head offering good support of the cutter unit in a radial direction.

By the embodiment according to the invention the mode of adjusting the cutter unit is exactly predefined by the previously selected spacer without involving the risk that said predefinition is inadvertently changed during the installation of the cutter unit in the receptacle on the carrier. Moreover, a good support on the carrier is achieved by means of the spacer. Said spacers may be used for cutter units consisting of a compact cutter made of the usual cutting steels as well as for cutter units consisting of a hard metal cutting plate and a support plate.

If an adjustment in more than two grades is desired, the spacers should usefully be provided in a set.

By the step according to claim 3 with the present invention the radial support is improved.

The spacer may be fastened to the cutter unit in advance so that the mounting of the cutter unit is facilitated.

Especially advantageous is the use of the embodiment according to the invention in a cutter unit comprising, a cutting plate and a support plate.

The invention provides a first preferred possibility to dispose the spacer between the cutting edge and the receptacle. There is also an additional possibility to dispose the spacer between the cutting edge and the receptacle.

With this invention the positional security of the spacer relative to the cutter unit is improved.

One embodiment of the pressure jaw described in this invention facilitates the mounting additionally. There is also described a particularly preferred embodiment of the pressure jaw facilitating both the mounting of the cutter unit and the adjustment thereof.

One embodiment of the pressure jaw generates a pressure force component acting inwardly in radial direction so as to facilitate the mounting and so as to guarantee a firmer seat of the cutter unit in the receptacle.

A preferred embodiment for a set of spacers used for the cutter head according to the invention.

BRIEF DESCRIPTION OF THE DRAWINGS

Embodiments of the invention will hereinafter by explained in more detail by means of the drawings, wherein.

DETAILED DESCRIPTION OF THE PREFERRED EMBODIMENT

Figure 1:
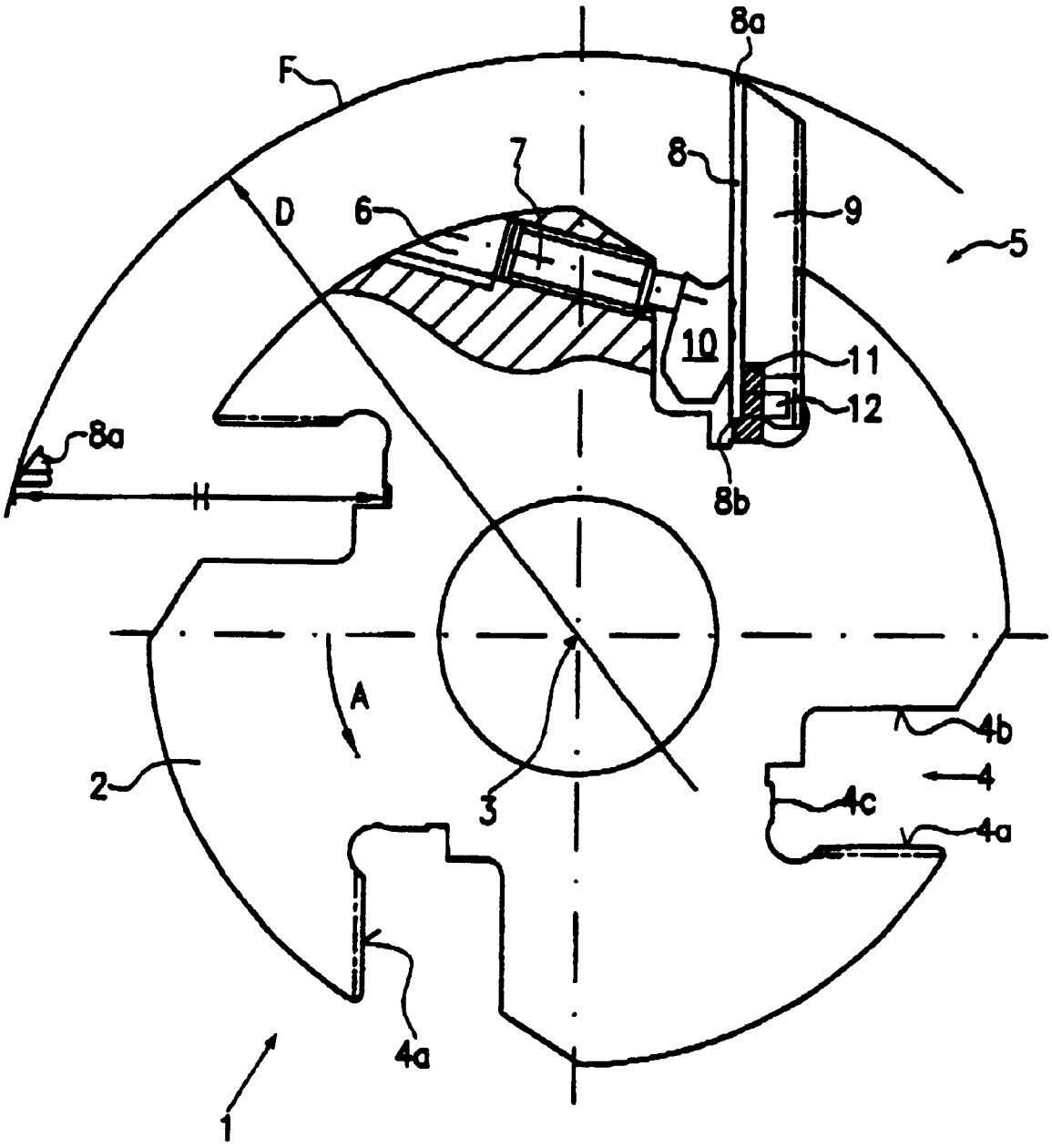
FIG. 1 shows a top view on a cutter head constructed according to the invention in a schematic illustration.

FIG. 1 shows a cutter head 1 constructed according to the invention, which, in the present embodiment, is designed as a milling cutter for wood working. The cutter head 1 comprises a cylindrical carrier 2, which, in the wood working machine, is rotatably driven in the direction of arrow A about a rotational axis 3 extending perpendicularly to FIG. 1. In the present embodiment four receptacles 4 for respectively one cutter unit 5 are distributed at regular intervals over the circumference of the carrier 2. Each of the receptacles 4 is, as is normal with said cutter heads, designed as a groove extending in axial direction relative to the rotational axis 3 and open in circumferential direction. Flanks 4*a* of each of the receptacles 4 after-running in the rotational direction A are designed as support surfaces for the cutter units 5 with flanks 4*a* of all receptacles 4 having the same alignment relative to the rotational axis 3 and the circumference of the carrier 2 and, if four cutter units 5 are used, being positioned to each other at right angles. The usual micro toothing may be disposed on flanks 4*a*, whereby the micro toothing, in the illustrated embodiment, serves the support against centrifugal forces during the operation and as positioning aid during the installation of the cutter unit, and which is shown in FIG. 1 in a dot-dash line.

Flanks 4*b* positioned opposite flanks 4*a* of each receptacle 4 are interspersed with an opening 6, in which a fastening bolt 7 or the like for fastening the cutter unit 5 in the carrier 2 can be accommodated and lowered beneath the surface of the carrier 2.

The base of each receptacle 4 has a bearing surface 4*c*, which is preferably slightly raised over the remaining lower periphery of the receptacle 4 and which is exactly aligned to the flank 4*a* in view of its angular position, i.e., in the present embodiment, it forms a right angle with flank 4*a*.

Each cutter unit 5 comprises in the illustrated embodiment a cutting plate 8 of hard metal having a cutting edge 8*a*, a support plate 9 placed behind the cutting plate 8, a pressure jaw 10 placed between bolt 7 and cutting plate 8 and a spacer 11 acting—as will be explained hereinbelow—as adjusting means, which is detachably connected with the support plate 9 by a catch spring 12.

Each of the cutter units 5 is disposed in the receptacle 4 such that the cutting edges 8*a* of all cutting plates 8 rotate on a common flight circle F with the diameter D about the rotational axis 3. Diameter D of the flight circle F should preferably be maintained also after the cutting edges 8*a* have been resharpened.

Figure 2:
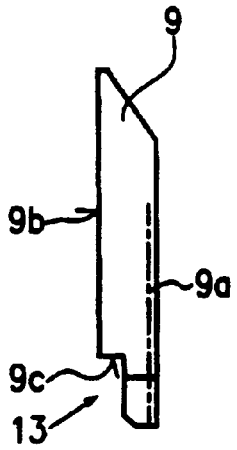
FIG. 2 shows the support plate of FIG. 1 in a lateral view.
Figure 3:
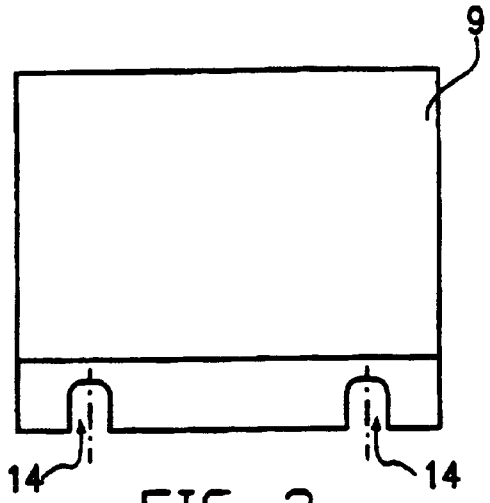
FIG. 3 shows the front view of FIG. 2.

The components of each cutting unit 5 will hereinafter be explained by means of FIGS. 2 to 9. As is shown in FIGS. 2 and 3 the support plate 9 may comprise a toothing 9*a* corresponding to the toothing of flank 4*a* resulting, apart from the pressure force caused by bolt 7, also in a form-fit engagement between the flank 4*a* of the receptacle 4 and the support plate 9. On the side opposite the toothing 9*a* the support plate 9 is provided with the support surface 9*b* for the cutting plate 8. In the area of the support plate 9 facing the base of the receptacle 4 a recess 13 is formed in the support surface 9*b*, which extends over the total axial width of the support plate 9 in the direction of the rotational axis 3 and which is open inwardly, i.e. in the direction of the rotational axis 3. The periphery 9*c* of recess 13 radially facing inwardly extends perpendicularly to the toothed reverse side 9*a* and to the support surface 9*b* so as to extend essentially parallel to the bearing surface 4*c* in the receptacle 4 and being positioned directly opposite thereof during the installation of the cutter unit 5. Two grooves 14 end in said recess 13 for fastening the catch spring 12.

Figure 4:
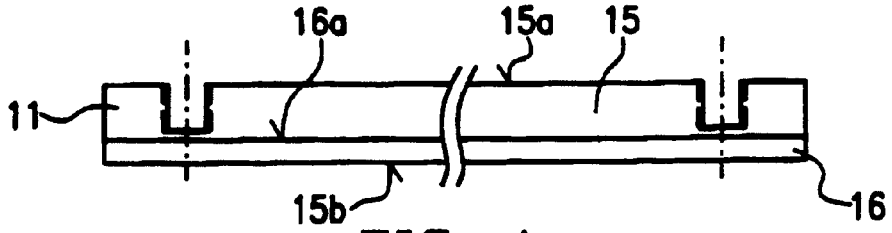
FIG. 4 shows the front view of the spacer of FIG. 1.
Figure 5:
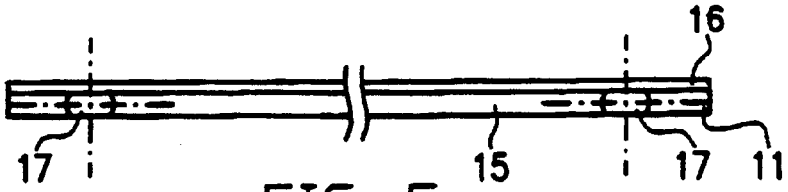
FIG. 5 shows the top view on the spacer of FIG. 1.
Figure 6:
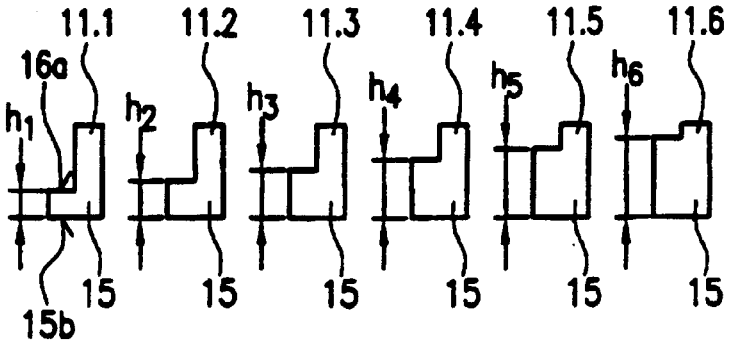
FIG. 6 shows a lateral view of a set of spacers for the cutter head according to FIG. 1.

The recess 13 is designed so as to accommodate the spacers 11 illustrated in FIGS. 4 to 6. The spacer 11 has a ledge-shaped basic body 15 having an upper side 15*a* and a likewise ledge-shaped shoulder 16 projecting from one of the two wider sides of the basic body 15 and being preferably designed to be integral with the basic body 15. Basic body 15 and shoulder 16 preferably have the same axial length as the support plate 9. On the upper side of the shoulder 16 a first bearing surface 16*a* is provided. The underside of the shoulder and basic body are flush and form a second bearing surface 15*b*. The upper side 15*a* of the basic body 15 corresponds in view of width and length essentially to the periphery 9*c* of the recess 13 of the support plate 9, so that the periphery 9*c* is supported on the upper side 15*a*, if the spacer 11 is received in the recess 13 and if no toothing is provided between the support plate 9 and flank 4*a*. If a toothing is provided, both surfaces 9*c* and 15*a* may have a distance to each other, which should be smaller or equal to half the tooth pitch (about 0.8 mm). In both cases the shoulder 16 projects over the support surface 9*b* so that the cutting plate 8 stands on the bearing surface 16*a* with its inwardly facing bearing surface 8*b*. Also the spacer 11 is provided with grooves 17, which, in a top view, are designed as part of a bore for receiving the catch spring 12, i.e. they have undercut peripheries.

By means of the spacer 11 it is possible to displace the cutting plate 8 relative to the support plate 9 and the rotational axis 3 further radially from the rotational axis 3 in an outward direction once the cutting edge 8*a* has been used up, so that the cutting edge 8*a* of the cutting plate 8 is positioned again with diameter D on the flight circle F after the resharpening, i.e. it has essentially the same distance H to the bearing surface 4*c* as it had prior to the resharpening. In principle this is feasible with only one spacer if a single adjusting possibility is enough, whereby the cutting plate 8 stands with its bearing surface 8*b* on the bearing surface, 4*c* of the receptacle 4 prior to the resharpening and is placed with its resting surface 8*b* onto the bearing surface 16*a* of the single spacer after the sharpening.

Preferably, however, a set of spacers 11 in different dimensional grades is provided, as is shown in FIG. 6. FIG. 6 shows a set of six spacers 11.1, 11.2, 11.3, 11.4, 11.5 and 11.6, whereof each shows an identically dimensioned basic body 15, however, staggered distances h ($h_1$, $h_2$, $h_3$, $h_4$, $h_5$, $h_6$) between the bearing surface 15*b* resting on the bearing surface 4*c* in the receptacle 4 and the bearing surface 16*a* on which rests the bearing surface 8*b* of the cutting plate 8.

If the cutting edge 8*a* is now to be resharpened, the user merely has to remove the cutter unit 5 from the receptacle 4, separate the possibly already used spacer 11 from the support plate 9 by releasing the catch spring 12, fasten the spacer of the following dimensional grade, for example, spacer 11.2, again on the support plate 9 by means of catch spring 12, insert the cutting plate 8 and fasten it again in the receptacle 4 by tightening bolts 7. Afterwards cutting edges 8*a* may be resharpened and the predetermined flight circle diameter D may be cut in again. The spacers 11 are sufficiently large to have them provided with a clearly visible mark so as to facilitate the exchange and to make sure that always the spacer of the directly following dimensional grade is used, so that an inadvertent higher adjustment of the cutting plate can no longer occur.

Figure 7:
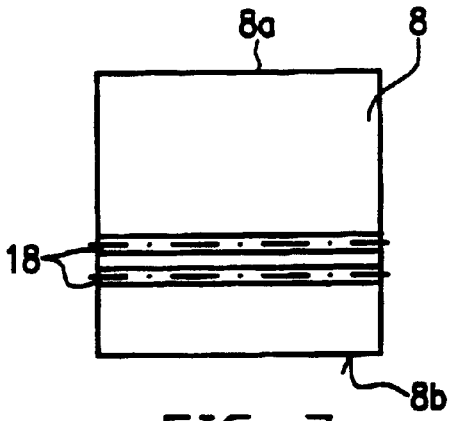
FIG. 7 shows a front view of a cutting plate usable for the cutter head according to FIG. 1.
Figure 8:
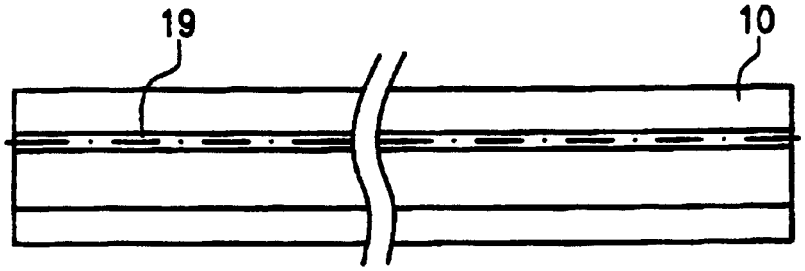
FIG. 8 shows a front view of a pressure jaw usable for the cutter head according to FIG. 1.
Figure 9:
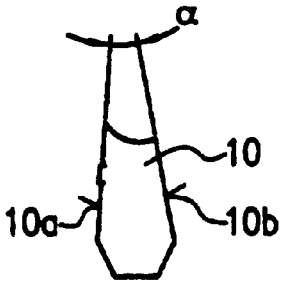
FIG. 9 shows the lateral view of the pressure jaw according to FIG. 1.

The mounting and the adjustment of the cutting plate 8 is improved by the form-fit connection between the cutting plate 8 and the pressure jaw 10 shown in FIGS. 7 to 9. As is shown in FIG. 7, the cutting plate 8 has two parallel grooves 18 extending in the rotational direction of the rotational axis 3, which are disposed at a spot of the cutting plate 8 positioned inside the receptacle 4 and opposite the pressure jaw 10, even if the cutting plate 8 was resharpened to the last possible dimension. It is not absolutely required that the grooves 18 are produced as dimensionally accurate and precise as the toothing between the support plate 9 and the flank 4*a*.

As is shown in FIGS. 8 and 9, the pressure jaw 10 has a shoulder 19 on the surface 10*a* facing the cutting plate 8 which is so dimensioned that it can immerse into the grooves 18 while the surface 10*a* presses against the cutting plate 8. Also the shoulder 19 extends over the entire axial length of the pressure jaw 10.

Opposite surface 10*a* a contact surface 10*b* for the bolt 7 is provided on the pressure jaw 10, which is even, straight and long enough in radial direction to the flight circle F that the bolt 7 finds a plurality of contact points. The contact surface 10*b* and surface 10*a* are inclined towards each other by an acute angle α, whereby the point having the greatest distance between surfaces 10*a* and 10*b* is arranged radially internally in view of the flight circle F. The angle a is so dimensioned that surface 10*b* extends essentially in the direction of diameter D of the flight circle F about the rotational axis 3 when the pressure jaw 10 is installed. Thus, if the bolt 7 contacts surface 10*b* a component of the fastening force acting radially inwardly is produced, which assists to retain the cutter unit 5 in the receptacle 4 even though the receiving recesses for bolts 7 known from the prior art are not provided. This allows an essentially infinitely variable alteration of the mutual position of bolts 7 and pressure jaw 10.

Due to the engagement of the shoulder 19 of the pressure jaw 10 with one of the two grooves 18 the pressure jaw 10 can thereby, during the installation, be positioned in its position relative to the cutting plate 8 and the support plate 9, so that the insertion is substantially facilitated. Depending on the spacer 11 used, the groove radially positioned further outside or radially positioned further inside is selected for a form-fit engagement of the shoulder 19, whereby the contact point of the bolt 7 on the surface 10*b* is infinitely variable.

FIGS. 10 to 14 show another embodiment of a support plate 109 comprising an associated spacer 111. The support plate 109 differs from the support plate 9 by the arrangement and the design of a recess 113, which, in the present embodiment, is designed as a groove extending over the entire axial length of the support plate 109. The recess 113 contains a bearing surface, or receiving surface 109*c*, facing radially towards the inside and a bearing surface, or receiving surface 109*d*, facing radially towards the outside. The support plate 109 may likewise be provided with a back toothing 109*a*. If this is not the case, the side of the support plate 109 facing radially towards the inside can be provided with another bearing surface 109*e* underneath recess 113, with which bearing surface 109*e* the support plate 109 is supported on a bearing surface 4*c* of the receptacle 4.

In said embodiment the support plate 109 is provided with a guiding mechanism for screws 114 for screwing the spacer 111. In the guiding mechanism for the screw 114 a non-illustrated slider may be received, which is defined in the predetermined position by a screw interspersing the support plate 109 and a screw opening 117 in the spacer 111.

Figure 12:
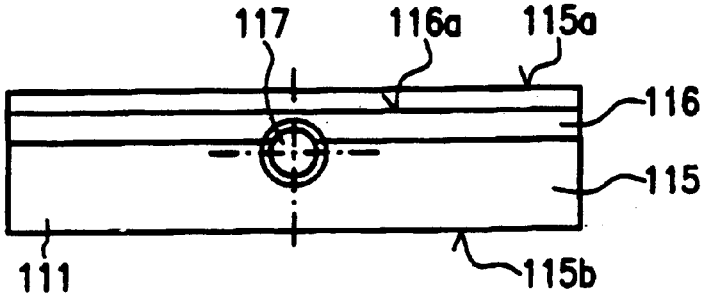
FIG. 12 shows the front view onto a spacer for the support plate according to FIG. 10.
Figure 13:
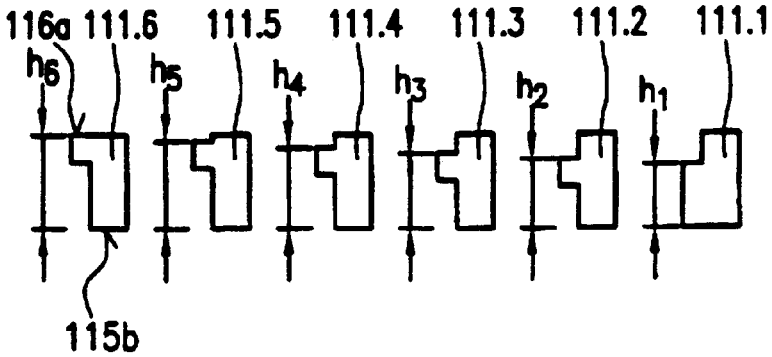
FIG. 13 shows the lateral view onto a spacer set for the support plate according to FIG. 10.

FIGS. 12 and 13 show spacers 111 to be used in the support plate 109. Each of the spacers 111 is provided with the same ledge-shaped basic body 115 the dimensions of which are so selected that it is accommodated in the recess 113, whereby each of the outwardly and inwardly facing peripheries 115*a* and 115*b* of the basic body 15 dash against the inwardly and outwardly facing receiving surfaces 109*c* and 109*d* of the support plate 109.

On the side facing the cutting plate 8 the basic body 115 is provided with a ledge-shaped shoulder 116 carrying on its radially outwardly facing side the bearing surface 116*a* for the resting surface 8*b* of the cutting plate 8. The shoulder 116 projects over the receiving surface 109*d* of the support plate 9.

Analogously to the first embodiment a set of spacers 111 (111.1, 111.2, . . . 111.6) is provided in different dimensional grades, i.e. with different distances h ($h_1$, $h_2$, . . . $h_6$) between the bearing surface, or supporting surface 116*a* and lateral edge 115*b*.

Figure 14:
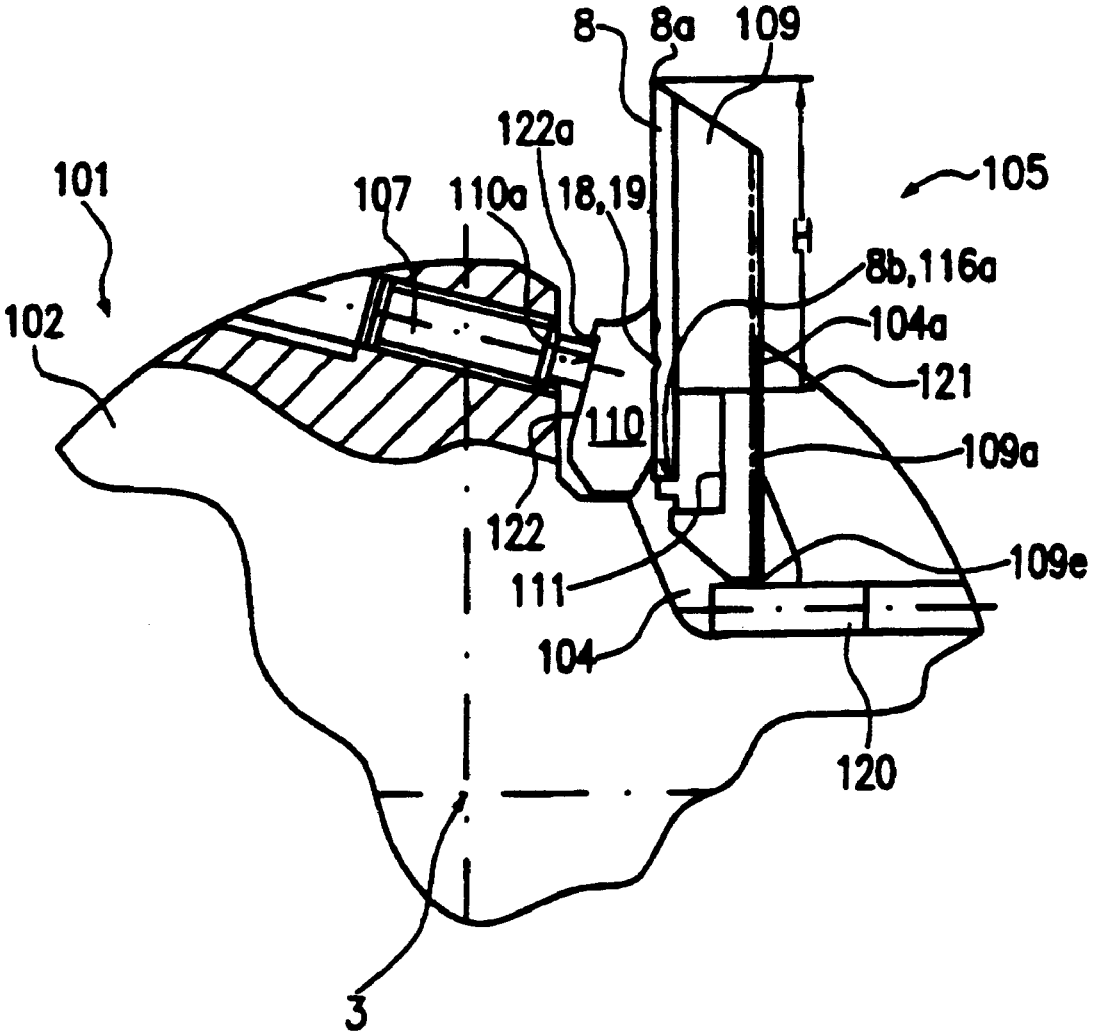
FIG. 14 shows a top view on another embodiment of a cutter head according to the invention.

FIG. 14 shows another embodiment of a cutter head 101 in an illustration according to FIG. 1, which, however, comprises the cutter unit according to FIGS. 10 to 13. The support plate 109 is provided with a back toothing 109*a* engaging into a back toothing 104*a* of a slightly modified receptacle 104. A pin 120 is provided on the cutter head extending in the base of the receptacle 104 until underneath the radially internally positioned surface 109*e* of the support plate 109, which has, however, a distance to surface 109*e* being smaller or equal to half the tooth pitch of the toothing 109*a* and 104*a* thereby serving as a mounting aid in embodiments comprising back toothings, which facilitates the insertion of the cutter unit 105 in the predetermined depth.

The support plate 109 and the body 102 of the cutter head 101 bear a locating mark 121 visually visible from outside, by which the correct position of the support plate 109 in the receptacle 104 is marked. In this embodiment the cutting plate 8 therefore is supported with its lower edge 8*b* on the bearing surface 116*a* of the spacer 111, and the spacer 111 is supported on the toothing 104*a* of the receptacle 104 in the carrier 102 via the surfaces of the recess 113 and the back toothing 109*a*. It is thereby secured by the marking 121 that the support plate 109 is always in the same radial position in the receptacle 104, no matter which of the spacers 111.1 to 111.6 is used.

If a support plate 109 without back toothing is used, the support plate 109 may also be supported with its lower surface 100*e* on the pin 120, whereby the marking 121 is then not required.

FIG. 14 further shows a modified pressure jaw 110, the surface 110*a* of which facing bolt 107 is disposed in a recess 122 being open in the direction of the rotational axis 3 of the carrier 102 and limited radially outwardly by a step 122*a*. The recess 122 is so arranged that the surface 110*a* again extends essentially radially.

The non-described details correspond to the details of the preceding embodiment.

Figure 10:
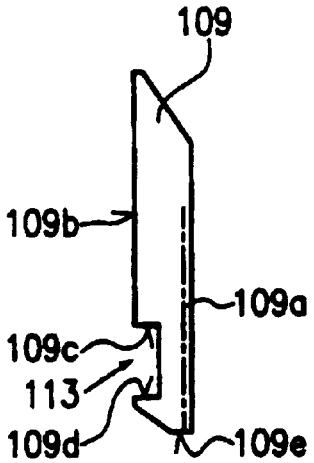
FIG. 10 shows a lateral view of another embodiment of a support plate for a a cutter head according to the invention.
Figure 11:
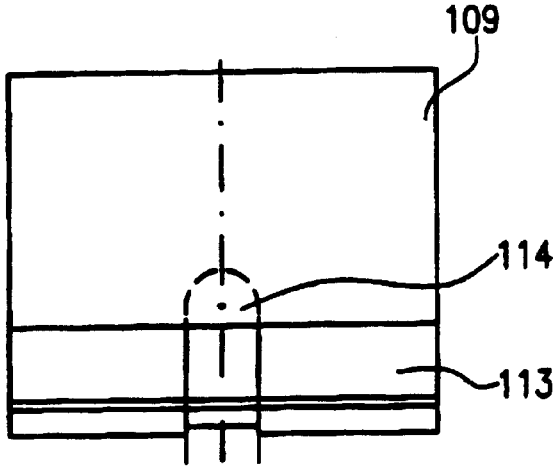
FIG. 11 shows the front view of FIG. 10.

It is, however, also possible to insert the spacer 11 according to FIGS. 4 to 6 in the recess 113 of the support plate 109 according to FIGS. 10 and 11, whereby the support plate 8 is not supported on the bearing surface 4*c* by the detour over the support plate 109, but solely by the portion of surface 15*b* of the spacer 11 projecting out of recess 113.

In modifications of the described and illustrated embodiments the invention cannot only be used for hard metal cutting plates, but, for instance, also for cutters made of common cutting steel (HS, HSS), whereby, in this case, the bearing surface for the support on the spacer is directly provided on the body of the cutter. The invention can, moreover, not only be used for milling cutters, but, for instance, also for plane knives. Also, the constructive design of the spacers is not restricted to the illustrated embodiments. Thus it is conceivable, for instance, to provide, in the embodiment according to FIG. 10, the support plate with a plurality of parallel groove receptacles into which one and the same spacer may be inserted in a height-adjustable fashion. Furthermore, also the spacer according FIGS. 4 to 6 may be fastened to the support plate or the body of the cutter by screwing. In axial direction both the ledge-shaped shoulder 16, 116 on the spacer 11, 111 and the grooves 18 in the cutting plate 8 can only be designed as partial supports, e.g. for a two-point contact. Said shape of the grooves may already be molded without problems into the cutting plate during the sinter-metallurgic production thereof, so that a metal removing molding, which is possible only with special tools, is not necessary.

I claim:

1. Cutter head for wood working machines comprising in combination a carrier provided with at least one receptacle for detachably receiving a cutter unit, means for adjusting the flight circle of a cutting edge of the cutter unit, said adjusting means comprising at least one spacer (11, 111) exchangeably disposed between said cutting edge (8*a*) and said receptacle (4, 104) for selectively adjusting and defining a distance (H) between said cutting edge (8*a*) and a bearing surface (4*a*, 4*c*, 104*a*, 120) of said receptacle (4, 104).

2. Cutter head according to claim 1, wherein said adjusting means comprises a set of said spacers (11.1, . . . 11.6; 111.1, . . . 111.6) in different dimensional grades ($h_1$, . . . $h_6$).

3. Cutter head according to claim 1, wherein said spacer (11, 111) is received in a recess (13, 113) of said cutter unit (5, 105).

4. Cutter head according to claim 1, wherein said spacer (11, 111) is detachably fastened to said cutter unit (5, 105).

5. Cutter head according to claim 1, wherein said cutter unit (5, 105) comprises a cutting plate (8) and a support plate (9, 109).

6. Cutter head according to claim 5, wherein said spacer (11) is placed between a resting surface (8*b*) on said cutting plate (8) and said bearing surface (4*c*) arranged in said receptacle (4).

7. Cutter head according to claim 5, wherein said spacer (111) is arranged between said resting surface (8*b*) on said cutting plate (8) and a receiving surface (109*c*, 109*d*) on said support plate (109), and that said support plate (109) is supported with a back toothing (109*a*) on a toothing (104*a*) of said receptacle (104).

8. Cutter head according to claim 5, wherein said support plate (9, 109) is provided with a recess (13, 113) for receiving said spacer (11, 111) which is so dimensioned that a supporting surface (16*a*, 116*a*) for said cutting plate (8) projects out of said recess (13, 113).

9. Cutter head according to claim 1, wherein said spacer (11, 111) is designed as a contact ledge having a ledge-shaped basic body (15, 115) and a ledge-shaped shoulder (16, 116) projecting from said basic body (15, 115), comprising a supporting surface (16*a*, 116*a*) for said cutter unit (5) extending over the entire axial length of said cutter unit (5, 105).

10. Cutter head according to claim 1, and wherein said cutter unit (5, 105) is fastened in said receptacle (4, 104) by means of a pressure jaw (10, 110), and a detachable form-fit connection (18, 19) is provided between surfaces facing each other on said pressure jaw (10, 110) and said cutter unit (5).

11. Cutter head according to claim 10, wherein said form-fit connection comprises a plurality of shoulders (19) arranged at a radial distance relative to said flight circle (F) on one of said surfaces and at least one corresponding shoulder (19) on said other surface.

12. Cutter head according to claim 11, wherein said pressure jaw (10, 110) which can be pressed against said cutter unit (5, 105) by means of a pressing means (7, 107) contacting a pressure surface (10*b*, 10*b*) on said pressure jaw (10, 110) offers in radial direction relative to said flight circle (F) a plurality of contact points for said pressing means (7, 107) spaced apart from each other.

13. Cutter head according to claim 12, wherein said pressure surface (10*b*, 10*b*) on said pressure jaw (10, 110) and said surface (10*a*) provided with said form-fit connection (18) are inclined towards each other at an acute angle ($\alpha$), whereby the distance of said two surfaces (10*a*, 10*b*, 110*b*) increases in the direction of the axis (3) of said flight circle (F).

14. Cutter head according to claim 12, wherein said pressure surface (10*b*, 10*b*) extends in radial direction relative to said flight circle (F).

15. Cutter head according to claim 1, wherein said spacer comprises at least a first and a second spacer member (11, 111) where each said spacer member is provided with a basic body (15, 115) and a shoulder (16, 116) having a said supporting surface (16*a*, 116*a*) for said cutter unit (5, 105), wherein said basic body (15, 115) of said first and the second spacer (11, 111) each has the same width between two lateral edges (15*a*, 15*b*, 115*a*, 115*b*) extending parallel to said shoulder (16, 116) and wherein the distance (h) of said supporting surface (16*a* 116*a*) of said first spacer (11, 111) to one of said lateral edges (15*b*, 115*b*) is different to said distance (h) of said second spacer (11, 111).

16. Cutter head according to claim 11, wherein said shoulders comprise recesses.

* * * * *